US007862154B2

(12) United States Patent
Onozawa

(10) Patent No.: US 7,862,154 B2
(45) Date of Patent: Jan. 4, 2011

(54) LIQUID EJECTION METHOD, LIQUID EJECTION HEAD AND LIQUID EJECTION APPARATUS

(75) Inventor: Sho Onozawa, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 271 days.

(21) Appl. No.: 12/239,612

(22) Filed: Sep. 26, 2008

(65) Prior Publication Data

US 2009/0085979 A1 Apr. 2, 2009

(30) Foreign Application Priority Data

Sep. 28, 2007 (JP) ..... 2007-256722

(51) Int. Cl.
*B41J 2/05* (2006.01)

(52) U.S. Cl. ..... 347/56

(58) Field of Classification Search ..... 347/56, 347/50, 54, 57–59, 61–65, 40, 42, 44, 47, 347/19, 20, 92

See application file for complete search history.

(56) References Cited

U.S. PATENT DOCUMENTS 4,301,459 A * 11/1981 Isayama et al. ..... 347/92
5,777,649 A * 7/1998 Otsuka et al. ..... 347/92
2009/0231401 A1 * 9/2009 Morgan et al. ..... 347/92

FOREIGN PATENT DOCUMENTS

JP 2003-94662 A 4/2003

* cited by examiner

*Primary Examiner*—K. Feggins
(74) *Attorney, Agent, or Firm*—Birch, Stewart, Kolasch & Birch, LLP.

(57) ABSTRACT

The liquid ejection method of ejecting liquid from a nozzle, includes the steps of: growing a column of the liquid from the nozzle; and injecting a bubble into a base of the column of the liquid during growth thereof from the nozzle, by using a bubble supply device which supplies a bubble.

12 Claims, 13 Drawing Sheets

50
54
53
51
52
58
510
511
4
41
51
48
42
44
43
S
M

LIQUID EJECTION METHOD, LIQUID EJECTION HEAD AND LIQUID EJECTION APPARATUS

BACKGROUND OF THE INVENTION

1. Field of the Invention

The present invention relates to a method for ejecting a liquid, a liquid ejection head and a liquid ejection apparatus.

2. Description of the Related Art

A so-called piezo type liquid ejection head is commonly used, which includes a nozzle that ejects liquid, a pressure chamber connected to the nozzle, and a piezoelectric element that causes the liquid to be ejected from the nozzle by changing the volume of the pressure chamber.

A so-called bubble jet type of liquid ejection head is also known, which ejects liquid from a nozzle by creating a bubble by heating the liquid.

Japanese Patent Application Publication No. 2003-094662 discloses a composition in which a gas channel for introducing gas in a direction perpendicular to the direction of ejection is arranged inside the nozzle, in such a manner that the liquid is previously split off inside the nozzle flow channel before the start of the ejection operation.

In a piezo type of liquid ejection head, in general, a drive signal of a pull-push-pull waveform is applied to the piezoelectric element so as to pull, push and pull the liquid in the nozzle to eject one droplet of the liquid. The beneficial effects of tearing off a liquid column protruding from the nozzle by means of final "pull" part of the waveform are important in creating a minute droplet, avoiding satellite droplets, and achieving high-speed output. As shown in FIG. 17, however, while the liquid column 34 keeps growing, the part connected to a meniscus (air-liquid interface) 31 in a nozzle 51 is pulled toward the nozzle. As a result of this, the ejection speed falls. Furthermore, a speed differential is produced between the leading portion of the liquid column and the tail portion of same, at the point in time that the liquid column 34 is severed, and due to this speed differential the flying liquid column takes a long time to form a spherical shape after severing. For this reason, the liquid column is liable to produce a plurality of satellite droplets before landing.

In a bubblejet type of liquid ejection head, the growth and contraction of the bubble caused by firm boiling simply have the same effects of the pushing and pulling waveforms, respectively, in the piezo type of liquid ejection head. Therefore, essentially, the above-described problems arise in a similar fashion to those of the piezo type of liquid ejection head. In the bubble jet type of liquid ejection head, in general, the bubble firstly grows in a closed state and then the gas inside the bubble contracts suddenly after ejection. As a result of this, the contracting force of the gas acts on the trailing end of the liquid column, and consequently, the liquid column is pulled and stretched.

In the composition described in Japanese Patent Application Publication No. 2003-094662, the liquid is previously split off inside the nozzle flow channel before the start of the ejection operation due to the introduction of gas in the direction perpendicular to the direction of ejection, and it is necessary to supply an extremely large volume of gas in comparison with a micro-bubble having the diameter of several micrometers (μm). Consequently, in actual practice, it takes time to refill the liquid, and the ejection speed declines further when continuous ejection is performed. Furthermore, from the viewpoint of 15 achieving high density of the nozzles, in actual practice it is difficult to install gas tubes for supplying a large volume of gas individually at the nozzles. It is also unavoidable that the liquid droplet volume will become large. Since it is necessary to extract a gas flow channel in some way, then there is also a separate problem in that robustness is poor when the compression of the gas is taken into account.

SUMMARY OF THE INVENTION

The present invention has been contrived in view of these circumstances, an object thereof being to provide a liquid ejection method, a liquid ejection head and a liquid ejection apparatus whereby the liquid column can be severed rapidly and the occurrence of satellites can be prevented without causing a decline in the ejection speed.

In order to attain the aforementioned object, the present invention is directed to a liquid ejection method of ejecting liquid from a nozzle, comprising the steps of growing a column of the liquid from the nozzle; and injecting a bubble into a base of the column of the liquid during growth thereof from the nozzle, by using a bubble supply device which supplies a bubble.

In order to attain the aforementioned object, the present invention is also directed to a liquid ejection method, comprising the steps of: applying pressure to liquid inside a nozzle and thereby pushing the liquid out from the nozzle to grow a column of the liquid from the nozzle; injecting a bubble into a base of the column of the liquid during growth thereof, the bubble having a diameter smaller than a diameter of the base of the column of the liquid; and severing the column of the liquid by the bubble and thereby causing the severed column of the liquid to fly off as a droplet of the liquid.

Preferably, the growing step includes the step of pushing initially a meniscus of the liquid in the nozzle in order to grow the liquid column from the nozzle; and the injecting step is carried out after the pushing step.

Preferably, the bubble is pushed out from a gas port disposed inside the nozzle, the bubble being pushed out along a direction in which the liquid is ejected from the nozzle.

Preferably, the bubble is pushed out from the gas port at a speed not less than a flow speed of the liquid at the base of the column of the liquid.

In order to attain the aforementioned object, the present invention is also directed to a liquid ejection head, comprising: a nozzle which ejects liquid; and a bubble supply device which injects a bubble into a base of a column of the liquid during growth thereof from the nozzle.

Preferably, the bubble supply device includes at least one of a gas port which outputs gas and a heating element.

Preferably, the bubble supply device is disposed on an ejection axis of the nozzle.

In order to attain the aforementioned object, the present invention is also directed to a liquid ejection apparatus comprising the above-described liquid ejection head.

Preferably, the liquid ejection apparatus further comprises: a drive device which synchronizes a liquid ejection waveform that defines push and pull timing of a meniscus of the liquid in the nozzle and a bubble supply waveform that defines injection timing of the bubble by the bubble supply device, and supplies the liquid ejection waveform and the bubble supply waveform to the liquid ejection head, wherein the bubble supply waveform has a pulse waveform for injecting the bubble after an initial pushing of the meniscus by means of the liquid ejection waveform.

According to the present invention, the liquid column is rapidly severed and satellite-free ejection can be achieved without any fall in the ejection speed. Furthermore, it is also possible to sever the liquid column by means of a micro bubble, and in this case, only a small amount of energy is required to generate and convey the bubble and hence satellite-free droplet ejection can be achieved in an efficient manner.

BRIEF DESCRIPTION OF THE DRAWINGS

The nature of this invention, as well as other objects and advantages thereof, will be explained in the following with reference to the accompanying drawings, in which like s reference characters designate the same or similar parts throughout the figures and wherein.

DETAILED DESCRIPTION OF THE PREFERRED EMBODIMENTS

Liquid Ejection Head

Figure 1B:
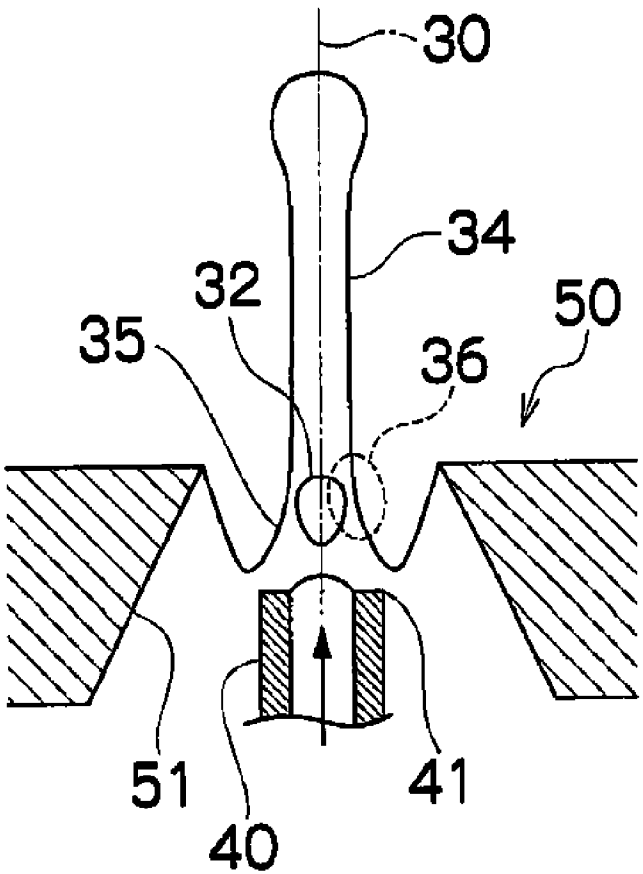
FIGS. 1A and 1B are cross-sectional diagrams showing the principal part of a liquid ejection head according to an embodiment of the present invention.
Figure 1A:
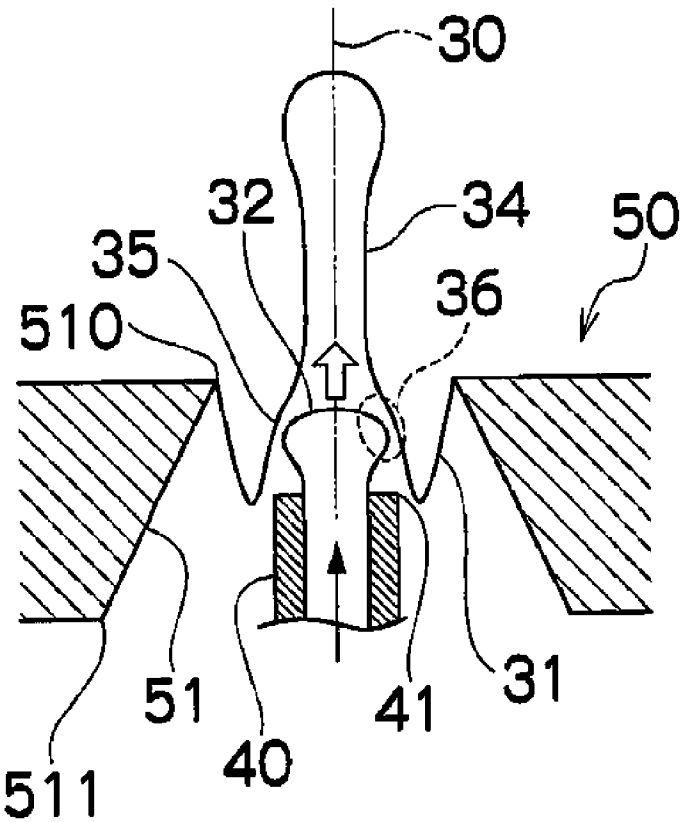

FIG. 1A shows the principal part of a liquid ejection head according to an embodiment of the present invention.

The liquid ejection head 50 has the nozzles 51 to eject droplets of liquid. The nozzles 51 according to the present embodiment have a so-called tapered shape in which the diameter of an outlet 510 (an aperture on the liquid ejection side) is smaller than the diameter of an inlet 511 (an aperture on the liquid supply side). A gas port 41, which expels gas, is disposed on the ejection axis 30 of the nozzle 51.

A bubble 32 is pushed out from the gas port 41 arranged on the ejection axis 30, in synchronization with the pull timing after pushing a meniscus (air-liquid interface) 31 in the nozzle 51. As a result of this, the bubble 32 is injected into the base 35 of a liquid column 34 during its growth. Consequently, a thin ligament 36 is produced.

The bubble 32 having been injected into the liquid column 34 is pushed out until the bubble 32 separates from the gas port 41 as shown in FIG. 1B, or until the ligament 36 breaks. The thin ligament 36 rapidly breaks due to surface tension. Thus, the liquid column 34 is rapidly severed before the liquid column 34 excessively grows.

Here, reference to "the gas port 41 being arranged on the ejection axis" is not limited to a case where the center of the opening of the gas port 41 coincides with the ejection axis 30, and it also includes a case where at least a part of the opening of the gas port 41 is positioned on the ejection axis 30. Furthermore, even if the gas port 41 is not situated on the ejection axis 30 (if the gas port 41 is disposed in the vicinity of the ejection axis 30), then it is still possible to apply the present invention provided that the gas port 41 is one which is able to inject the bubble 32 at the base 35 of the liquid column 34.

In the present invention, the topology of the liquid column 34 is altered by the bubble 32. In other words, a new air-liquid interface is added inside the liquid column 34. Thus, the liquid column 34 is rapidly severed and satellite-free ejection is achieved without any fall in the ejection speed. Furthermore, the bubble 32 can be injected into the liquid column 34 in the form of an extremely small micro-bubble having the diameter of 1 μm to 5 μm, and only a small amount of energy is required in order to generate and convey the bubble 32. Hence, it is possible to avoid the occurrence of satellite droplets and to achieve minute droplets, in an efficient manner.

Figure 2:
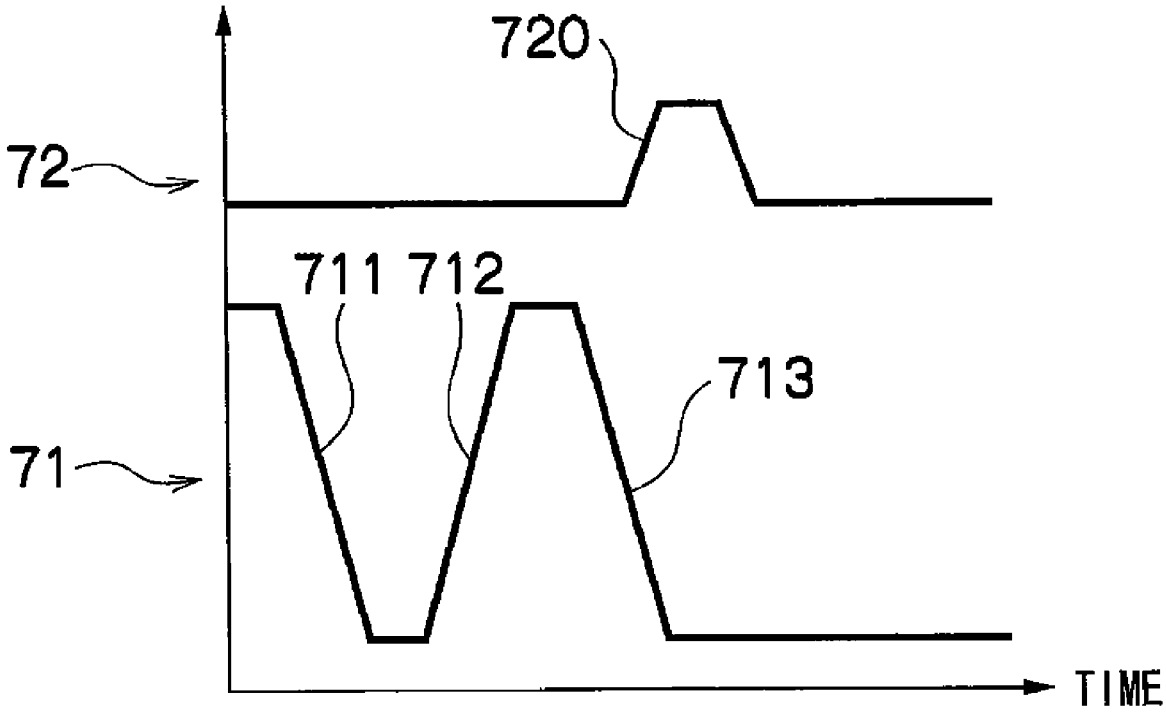
FIG. 2 is a waveform diagram showing a liquid ejection pressure waveform and a gas supply pressure waveform in the present embodiment.

FIG. 2 is a timing chart showing a pressure waveform 71 for liquid ejection and a pressure waveform 72 for supplying a bubble according to the present embodiment.

The liquid ejection pressure waveform 71 is a waveform that is applied to the liquid inside the nozzle 51 in order to eject a droplet of the liquid from the nozzle 51, and it is constituted of an initial pulling waveform 711, an initial pushing waveform 712 and a second pulling waveform 713.

In FIG. 2, in order to simplify the illustration, the portion of the liquid ejection pressure waveform 71 after the second pulling waveform 713 is depicted with a straight line similarly to a steady state; however, in actual practice, there are pushing and pulling waveforms as residual vibrations subsequent to the second pulling waveform 713.

The bubble supply pressure waveform 72 is a waveform that is applied to the gas inside the gas tube 40 in order to supply the bubble 32, and has a pulse waveform 720 at the timing at which the bubble 32 is to be injected into the liquid column 34.

If the bubble 32 is pushed out from the gas port 41 at the very middle of the initial pushing waveform 712 of the liquid ejection pressure waveform 71, then the bubble 32 that has become enveloped inside the liquid column 34 is stretched in conjunction with the growth of the liquid column 34. As a result of this, ultimately, a large number of satellite droplets are generated. This effect is particularly notable in the taper-shaped nozzle 51. The reason for this is that the flow speed vector in the nozzle 51 is directed toward the center or the ejection axis 30, and therefore the bubble 32 is also compressed toward the ejection axis 30 and is stretched to a long and thin shape inside the liquid column 34. Hence, it is desirable to push out the bubble 32 from the gas port 41 by means of the pulse waveform 720, either at an intermediate point or at the end point of the pulling waveform 713, which is after the initial pushing waveform 712 serving to grow the liquid column, as shown in FIG. 2.

In the above-described embodiment, the pulse waveform 720 for injecting the bubble is present during the pulling waveform 713 immediately after the initial pushing waveform 712; however, the present invention is not limited to a case of this kind and the present invention also includes cases where the pulse waveform 720 is present during the pulling or pushing waveforms in the residual vibrations, which are not shown in the drawing.

Figure 3:
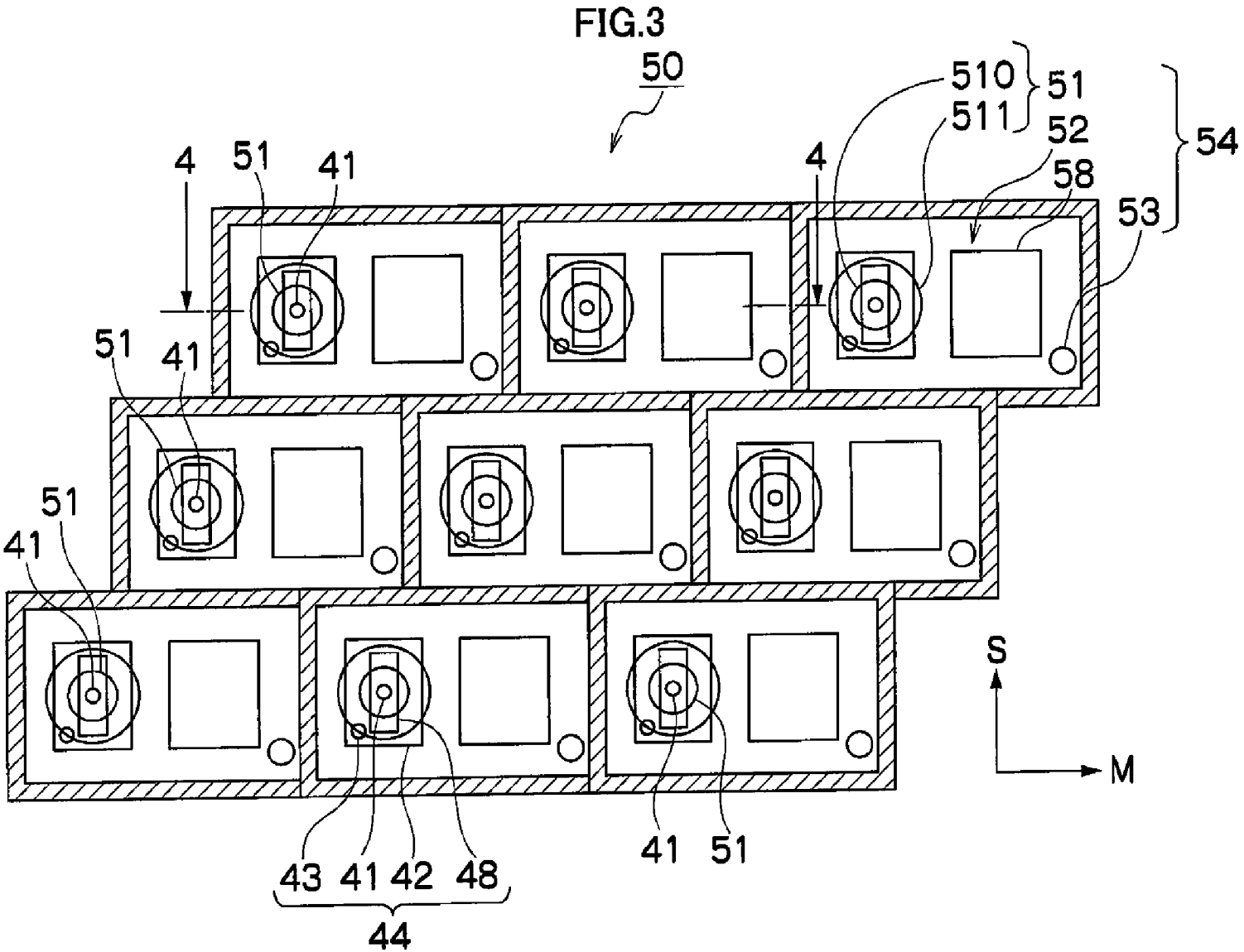
FIG. 3 is a plan view perspective diagram showing the general structure of the liquid ejection head.

FIG. 3 is a plan view perspective diagram showing the liquid ejection head according to the present embodiment in the case of a multiple nozzle configuration. Constituent elements that have already been shown in FIGS. 1A and 1B are denoted with the same reference numerals as in FIGS. 1A and 1B.

The liquid ejection head 50 in FIG. 3 is a so-called full line head, having a structure in which the plurality of nozzles 51, which eject droplets of liquid toward an ejection receiving medium, are arranged in a two-dimensional configuration through a length corresponding to the width of the ejection receiving medium in the direction perpendicular to the direction of conveyance of the ejection receiving medium (the sub-scanning direction indicated by arrow S in FIG. 3), in other words, in the main scanning direction indicated by arrow M in FIG. 3.

Figure 4:
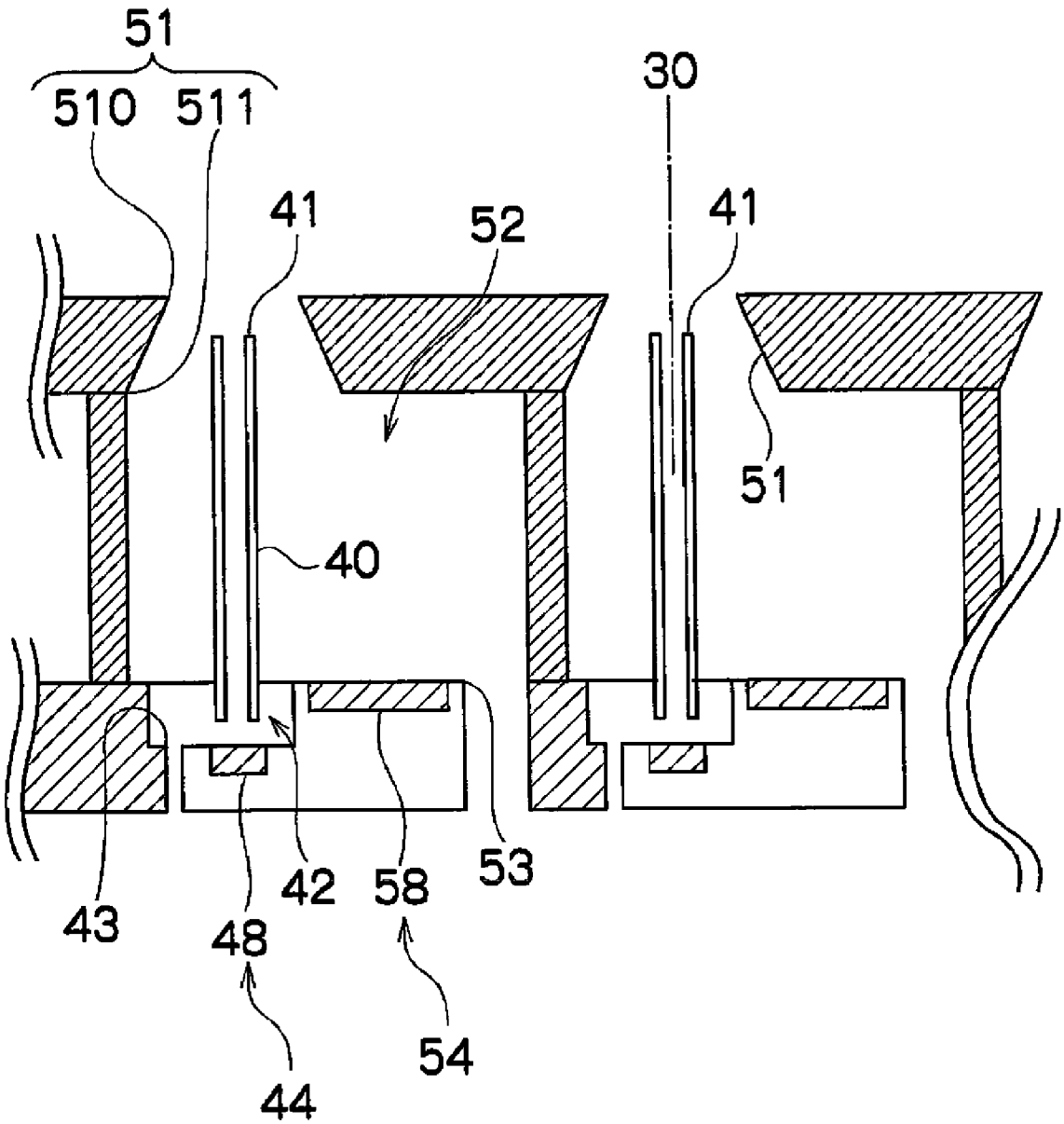
FIG. 4 is a cross-sectional diagram along line 4-4 in FIG. 3.

FIG. 4 is a cross-sectional diagram along line 4-4 in FIG. 3.

In the liquid ejection head 50, a plurality of liquid ejection elements 54 are arranged in two directions, namely, the main scanning direction M and an oblique direction, which forms a prescribed acute angle with respect to the main scanning direction M. Each of the liquid ejection elements 54 includes the nozzle 51, a pressure chamber 52 connected to the nozzle 51, a liquid supply port 53 for supplying the liquid to the pressure chamber 52, and a piezoelectric element 58 for the liquid ejection, which causes the liquid to be ejected from the nozzle 51 by changing the volume of the pressure chamber 52. The liquid supply ports 53 of the pressure chambers 52 are connected to a liquid flow channel, which is common to the plurality of pressure chambers 52.

Furthermore, in the liquid ejection head 50, a plurality of bubble supply elements 44 are arranged in the two directions, namely, the main scanning direction M and the oblique direction, which forms the prescribed acute angle with respect to the main scanning direction M. Each of the bubble supply elements 44 includes a gas port 41, a gas chamber 42 connected to the gas port 41 through a gas pipe 40, a gas supply port 43 for supplying the gas to the gas chamber 42, and a piezoelectric element 48 for the bubble supply, which causes the bubble to be ejected from the gas port 41 by changing the volume of the gas chamber 42. The gas supply ports 43 of the gas chambers 42 are connected to a gas flow channel, which is common to the plurality of gas chambers 42.

In FIGS. 3 and 4, for the sake of convenience, only a portion of the liquid ejection elements 54 and a portion of the bubble supply elements 44 are depicted.

Figure 16:
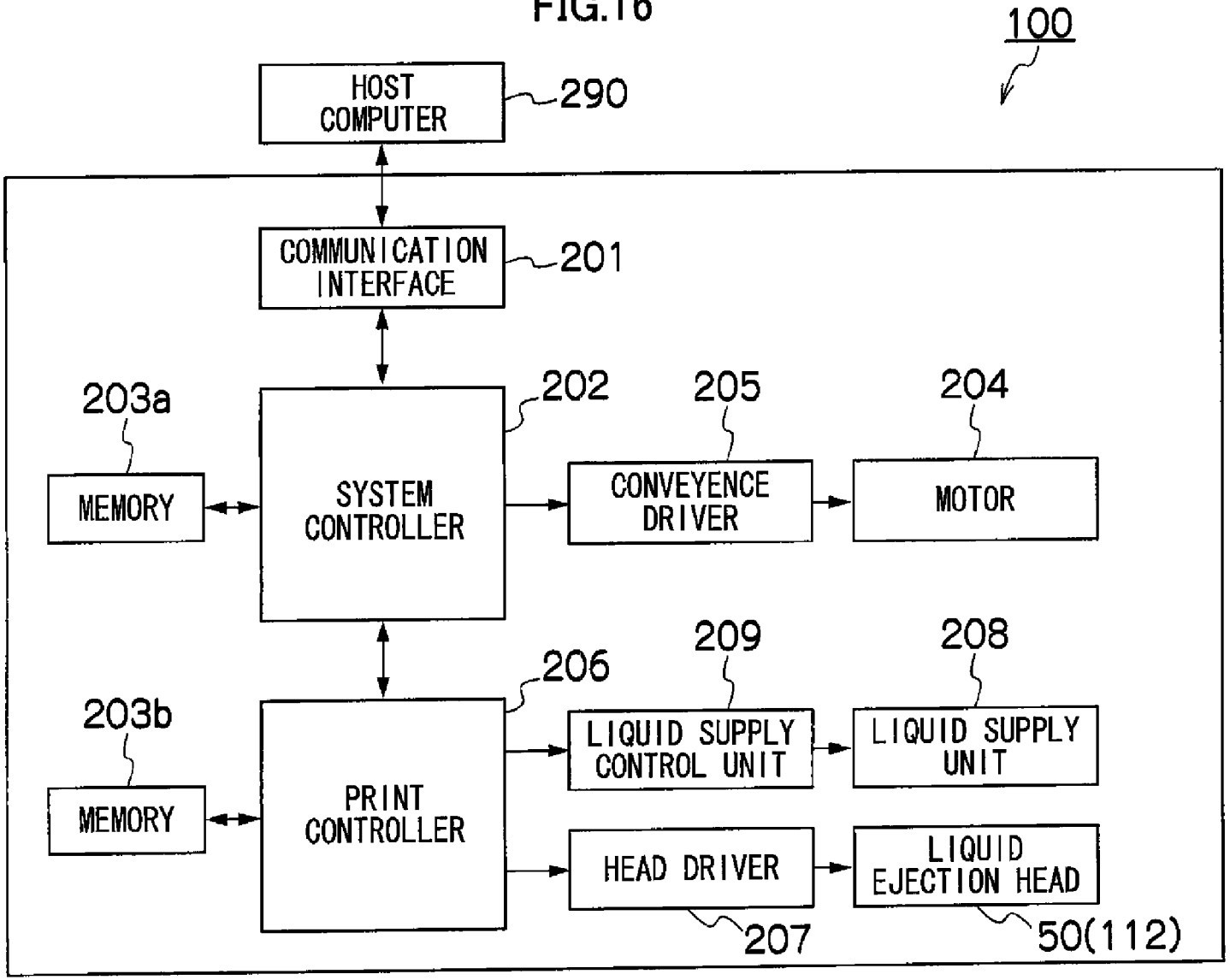
FIG. 16 is a block diagram of the control system of the image forming apparatus.

A liquid ejection drive signal corresponding to the liquid ejection pressure waveform s 71 in FIG. 2 is applied from a head driver 207, which is shown in FIG. 16 and described later, to each of the piezoelectric elements 58 of the liquid ejection elements 54. Furthermore, a bubble supply drive signal corresponding to the bubble supply pressure waveform 72 in FIG. 2 is applied from the head driver 207 to each of the piezoelectric elements 48 of the bubble supply elements 44. The head driver 207 synchronizes the liquid ejection pressure waveform 71, which defines the push and pull timing of the meniscus in the nozzle 51, and the bubble supply pressure waveform 72, which defines the timing of the injection of the bubble from the gas port 41. Due to this synchronization, after the meniscus in the nozzle 51 is pushed initially in order to grow the liquid column, the bubble is injected into the liquid column during the growth of the liquid column.

The gas pipe 40 has the gas port 41 at one end, and the other end thereof is connected to the gas chamber 42. The gas pipe 40 according to the present embodiment is disposed in parallel to the ejection axis 30 of the nozzle 51.

In the liquid ejection head 50 of this kind, by changing the volume of the gas chamber 42 by means of the piezoelectric element 48 of the bubble supply element 44, the bubble is pushed out along the liquid ejection direction of the nozzle 51, from the gas port 41, which is disposed inside the nozzle 51. The surface from which the bubble is generated and the nozzle surface are disposed substantially parallel to each other. In other words, the liquid ejection direction and the bubble injection direction substantially coincide with each other.

In the liquid ejection direction, the bubble is pushed out from the gas port 41 at a speed that is equal to or greater than the flow speed of the liquid at the base of the liquid column (the liquid in the vicinity of the gas port 41).

In FIG. 2, the liquid ejection pressure waveform 71 does not necessarily correspond to the actual waveform of the liquid ejection drive signal that is applied to the piezoelectric element 58 of the liquid ejection element 54. For example, the present invention can also be applied to a case where the waveform corresponding to the second pulling waveform 713 is omitted from the liquid ejection drive signal, in other words, a case where the second pulling waveform is formed by spontaneous recoiling of the meniscus.

The desired conditions for injecting the bubble into the liquid column 34 are described below.

Figure 5A:
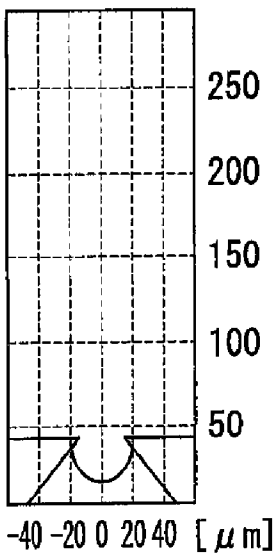
FIGS. 5A to 5D are diagrams showing the changes in the meniscus in a case where a bubble is not injected.
Figure 5B:
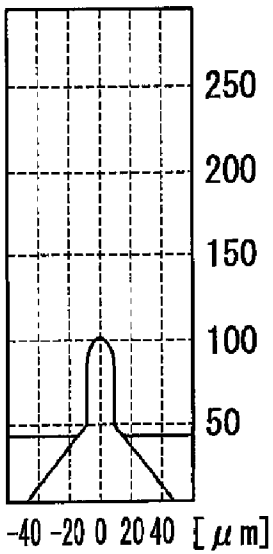
Figure 5C:
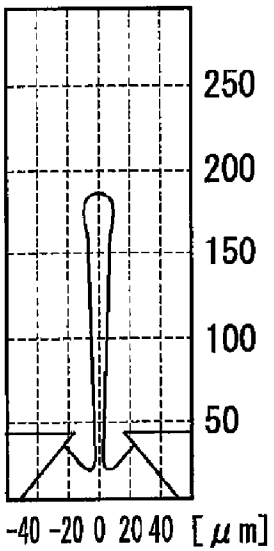
Figure 5D:
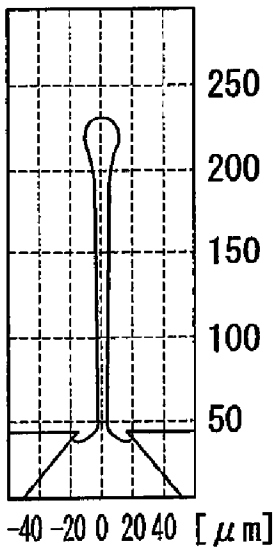

FIGS. 5A to 5D show the change in the meniscus (air-liquid interface) when no bubble 32 is injected into the liquid column 34. FIG. 5A shows the meniscus after an initial pull, FIG. 5B shows the meniscus after an initial push, FIG. 5C shows the meniscus after a second pull and FIG. 5D shows the meniscus after a second push. Here, "pull" and "push" are descriptions based on the resulting shape of the meniscus, and they are not necessarily caused only by the liquid ejection drive signal applied to the piezoelectric element 58 of the liquid ejection element 54. For example, the spontaneous recoiling of the meniscus also contributes to the change from FIG. 5C to FIG. 5D.

When the bubble 32 is injected into the liquid column 34, particular attention is required in respect of the injection timing and injection position of the bubble.

Figure 6A:
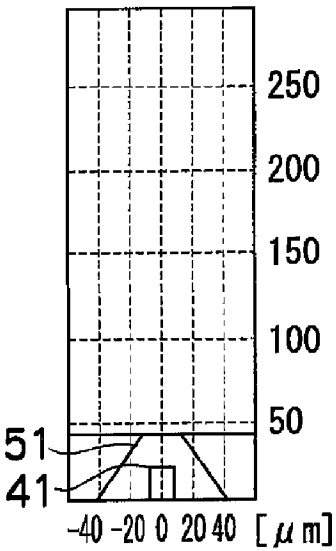
FIGS. 6A to 6E are diagrams showing the changes in the meniscus in a case where a bubble is injected during the initial pushing action.
Figure 6B:
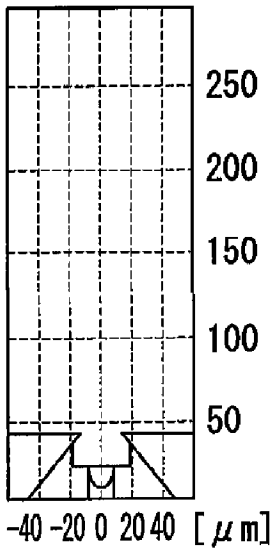
Figure 6C:
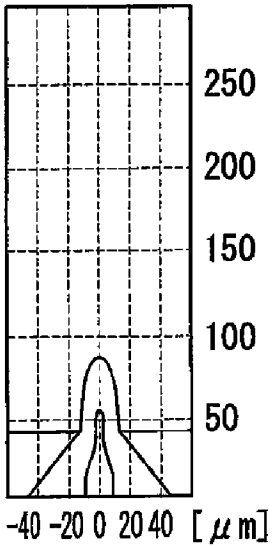
Figure 6D:
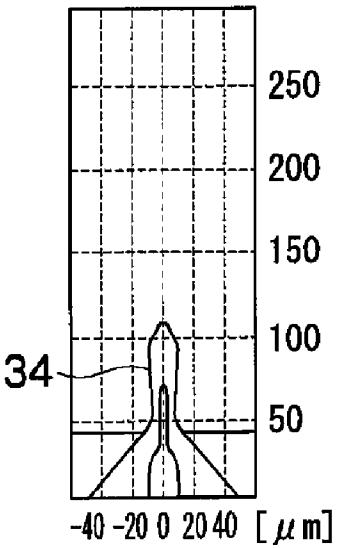
Figure 6E:
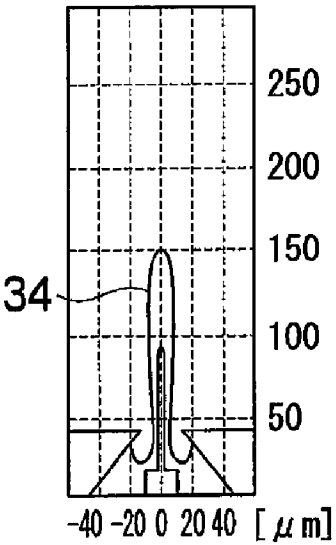

A case where a bubble is pushed out during the initial pushing action is now described with reference to the schematic drawings in FIGS. 6A to 6E. FIG. 6A shows a state before the meniscus in the nozzle 51 is pulled and while the gas (in the present embodiment, the air) still has not exited from the gas port 41. FIG. 6B shows a state where the meniscus has been pulled, immediately before the exit of the gas. FIG. 6C shows a state where the meniscus has started to be pushed, and where injection of gas into the liquid that has started to stretch (initial liquid column) has commenced. If the gas exits during the initial pushing of the meniscus in this way, then as shown in FIGS. 6D and 6E, the gas enclosed inside the liquid column 34 also stretches in conjunction with the growth of the liquid column 34. The gas column inside the liquid column 34 therefore breaks into a plurality of bubbles and consequently a plurality of satellite droplets are produced as a result.

This problem is also dependent on the speed and volume of the gas that is pushed out. It is considered that the above-described problem will not occur provided that the gas is pushed out at a sufficiently fast speed compared to the flow speed of the liquid, or provided that the gas is pushed out in the form of a bubble having a diameter close to the outlet diameter of the nozzle 51. However, since careful attention must be paid to the injection speed and volume of the gas, then it is desirable to push out the gas from the gas port 41 at the timing of the pulling action after the initial pushing of the meniscus inside the nozzle 5 1, as shown in FIGS. 1A and 2, rather than at the timing such as that shown in FIG. 6C.

Figure 7A:
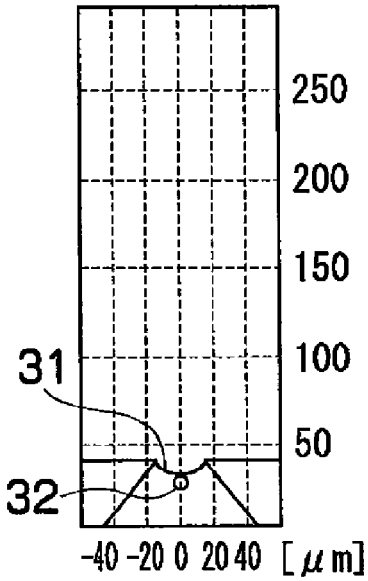
FIGS. 7A to 7C are diagrams showing the changes in the meniscus in a case where a bubble is released into the outside air.
Figure 7B:
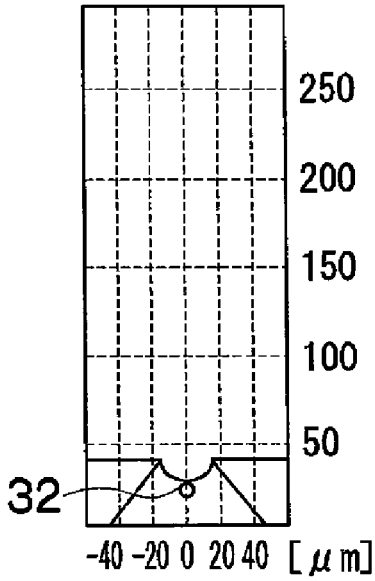
Figure 7C:
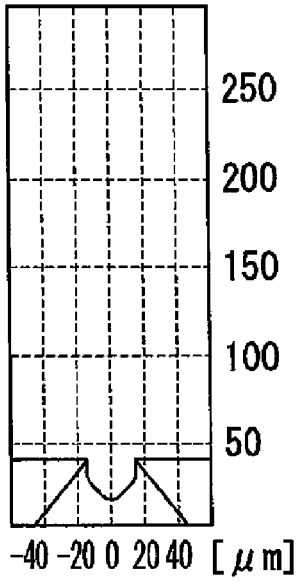
Figure 8A:
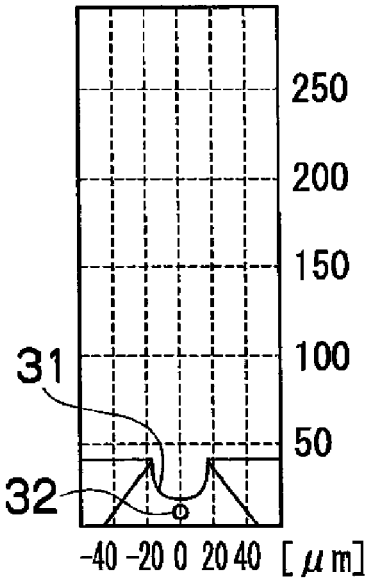
FIGS. 8A to 8C are diagrams showing the changes in the meniscus in a case where a bubble is positioned in the leading portion of the liquid column.
Figure 8B:
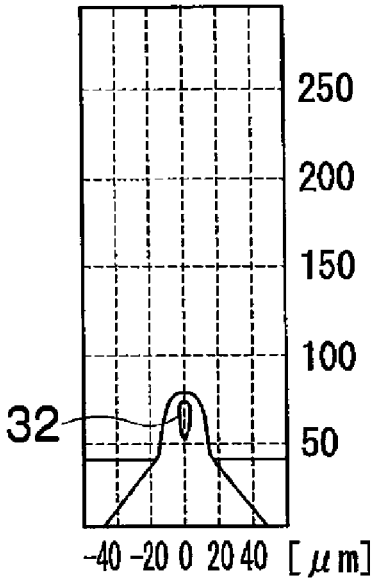
Figure 8C:
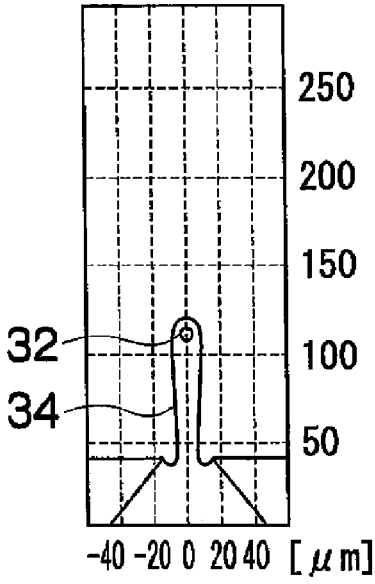
Figure 9A:
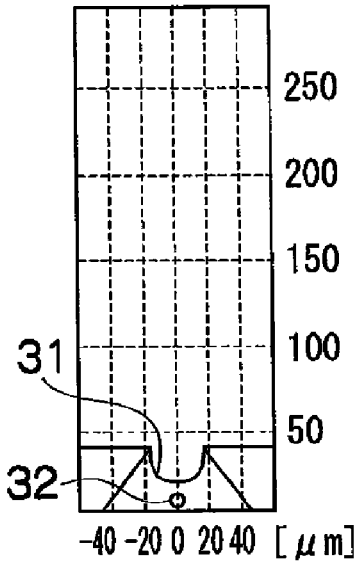
FIGS. 9A to 9C are diagrams showing the changes in the meniscus in a case where a bubble is stretched and distributed inside the liquid column.
Figure 9B:
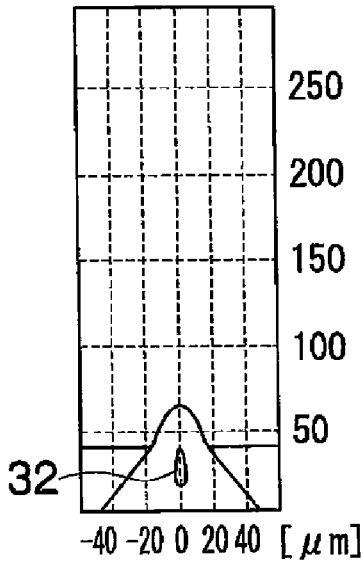
Figure 9C:
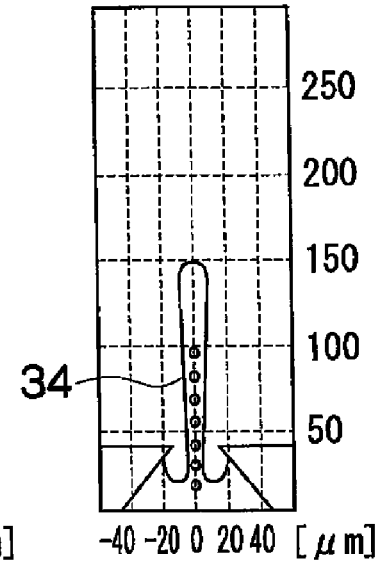

The timing and the positions are described in detail respectively for a case where the bubble is large and a case where the bubble is small, with reference to FIGS. 7A to 9C, in which the diameter of the bubble 32 is 7.5 μm in FIG. 7A, 9 μm in FIG. 8A and 7.5 μm in FIG. 9A.

Large bubbles having the diameters of 5 μm to 10 μm are not burst or dissolve; however, if a large bubble is injected at an early stage when the meniscus starts to be pulled, and if the position where the bubble 32 is introduced is close to the meniscus 31 as shown in FIG. 7A, then there is a possibility that the bubble escapes into the outside air and disappears during the pulling action as shown in FIGS. 7B and 7C. Even if the bubble 32 is introduced at a position that is distant from the meniscus 31 as shown in FIG. 8A, so as to prevent the to occurrence of problems of this kind, the bubble 32 is situated in the leading portion of the liquid column 34 and therefore does not contribute to the severance of the liquid column 34, as shown in FIGS. 8B and 8C. If the bubble 32 is introduced at a position that is further distant from the meniscus 31 as shown in FIG. 9A, then from the state shown in FIG. 9B the bubble 32 is pulled and stretched simultaneously with the growth of the liquid column 34 and becomes 15 distributed inside the liquid column 34 in the form of minute bubbles as shown in FIG. 9C. Therefore, it is inevitable that the liquid column 34 breaks up into minute droplets. Moreover, although not shown in the drawings, the bubble 32 moves back and forth around its original position inside the nozzle 51 and therefore does not contribute in any way to the severance of the liquid column 34.

Consequently, as shown in FIG. 1A, it is desirable that the bubble 32 is introduced once a clear junction point has been formed between the meniscus 31 in the nozzle 51 and the liquid column 34.

A small bubble having the diameter of less than 5 μm is not pulled and stretched in the same way as the large bubble, but the injection timing and position have the same effects as those of the large bubble. In the case of the small bubble, if the bubble is introduced at an early stage when the meniscus starts to be pulled, then the bubble bursts or dissolves at the position where the pressure variation is particularly great, and therefore essentially it is inevitable that the bubble will have already disappeared by the time that the liquid column severs.

Hence, although the effects to be taken into account slightly vary depending on the size of the bubble, it is desirable that the bubble 32 is injected into the base 35 of the liquid column 34 having a constricted shape after initial pushing of the meniscus 31 in the nozzle 51, as shown in FIG. 1A. It is more desirable that the bubble is injected during the latter half of the pulling action that is performed immediately after the initial pushing action. It is furthermore desirable that the bubble is injected at the end point of the pulling action that is performed immediately after the initial pushing action.

The diameter of the bubble 32 injected into the liquid column 34 is less than the diameter of the base of the liquid column 34. According to common sense, the diameter of the base of the liquid column 34 is equal to or less than the diameter of the outlet 510 of the nozzle 51.

In the case shown in FIGS. 5A to 5D described above, the diameter of the base 35 of the liquid column 34 at the time in FIG. 5C (in other words, the pulling end time) is approximately 4 μm to 5 μm, and it is considered to be sufficient provided that the conditions enable the above-described "small bubble" to be injected in a suitable fashion.

Figure 10A:
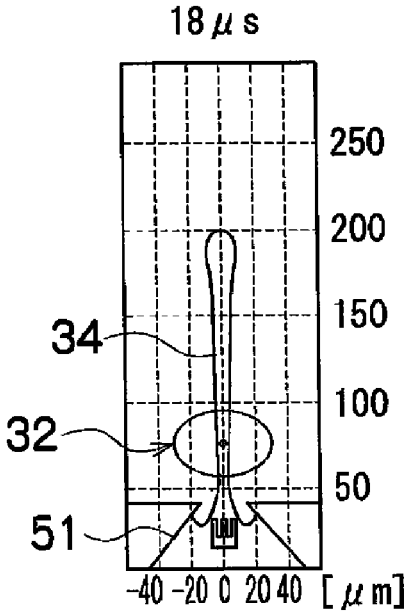
FIGS. 10A and 10B are diagrams showing the changes in the meniscus in a case where a bubble is injected in a suitable fashion.
Figure 10B:
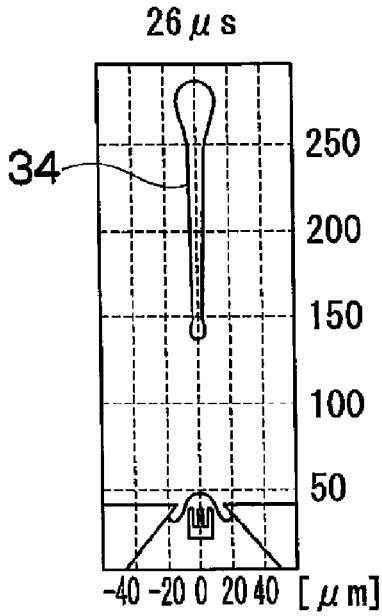

FIGS. 10A and 10B show results of a simulation for a case where the bubble 32 is injected into the liquid column 34 in a suitable fashion. The simulation conditions were as follows:

Viscosity of liquid: 10 cP;

Diameter of nozzle inlet: 72 μm;

Diameter of nozzle outlet: 24 μm;

Thickness of nozzle plate: 30 μm; and

Diameter of bubble: 1 μm.

The simulation was carried out by disposing a circular rod formed with two circular grooves having a width of 1 μm on the ejection axis of the nozzle 51 and arranging air in the groove regions. In this case, although the grooves are not connected to the outside air, the negative pressure created by ejection is sufficient to pull out the air inside these grooves and consequently, a minute bubble 32 is incorporated into the liquid column 34.

Figure 17:
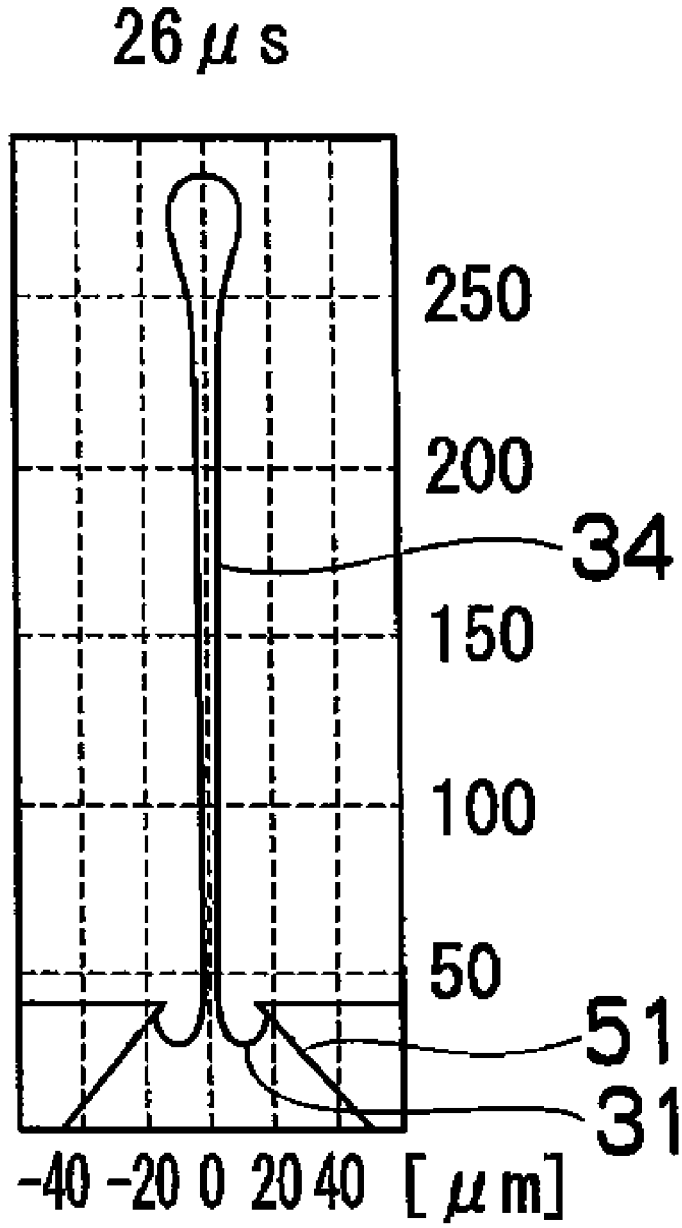
FIG.17 RELATED ART
FIG. 17 is an illustrative diagram used to describe a liquid ejection method according to the related art.

The present embodiment shown in FIGS. 10A and 10B is compared to the related art shown in FIG. 17. The speed waveform of the liquid supplied to the inlet of the nozzle 51 (created by the pull-push-pull waveform) is the same in both the related art in FIG. 17 and the embodiment of the present invention in FIGS. 10A and 10B. FIG. 10A shows the state of approximately 18 μs after applying the speed waveform to the liquid, FIG. 10B shows the state of approximately 26 μs after applying the speed waveform to the liquid, and FIG. 17 shows the state of approximately 26 μs after applying the speed waveform to the liquid. In the related art shown in FIG. 17, the liquid column 34 is still connected to the meniscus 31 in the nozzle 51 for approximately 26 μs after applying the speed waveform to the liquid. On the other hand, in the embodiment of the present invention as shown in FIG. 10B, early severance of the liquid column 34 occurs and there is virtually no decline in the ejection speed.

The above-described device for injecting the bubble into the liquid column includes the liquid port 41 arranged on the ejection axis 30 of the nozzle 51, and the gas is pushed out from the liquid port 41 by the pressure; however, the present invention is not limited to cases of this kind.

Figure 11:
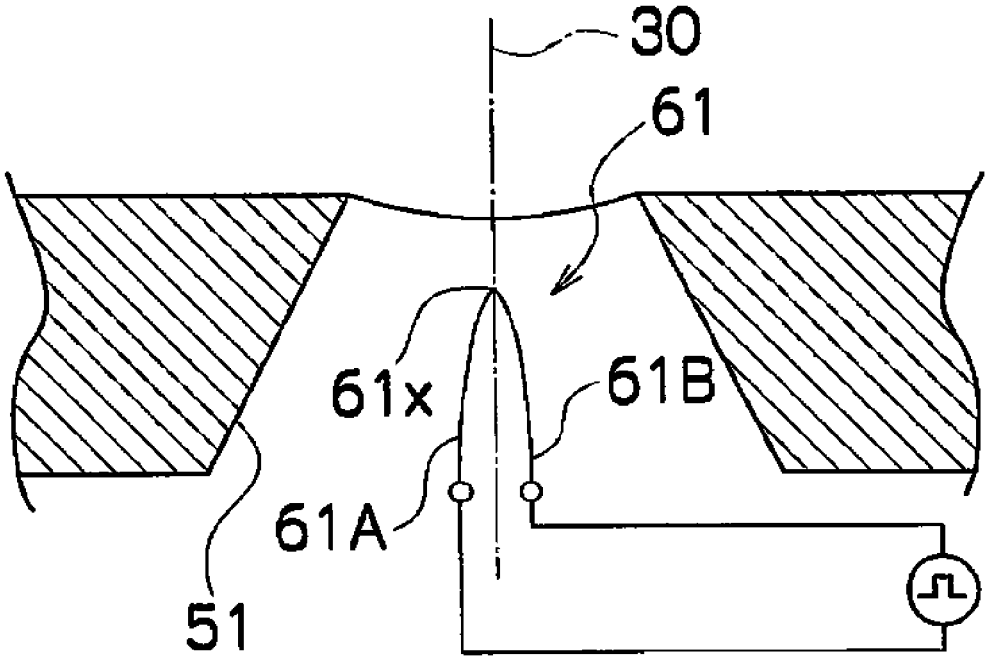
FIG. 11 is a cross-sectional diagram showing the principal part of a liquid ejection head having a thermocouple.

FIG. 11 shows a case where a thermocouple (heat generating resistance) 61 is disposed on the ejection axis 30 of the nozzle 51. A bubble is generated by the phase change, electrolysis reaction, or the like, created in the liquid by the heat of the thermocouple 61. For the thermocouple 61, for example, different metals 61A and 61B that produce the Seebeck effect at the junction between same 61X are used. As the materials of the different metals 61A and 61B, a nickel alloy and a chrome alloy are used, for example.

Figure 12:
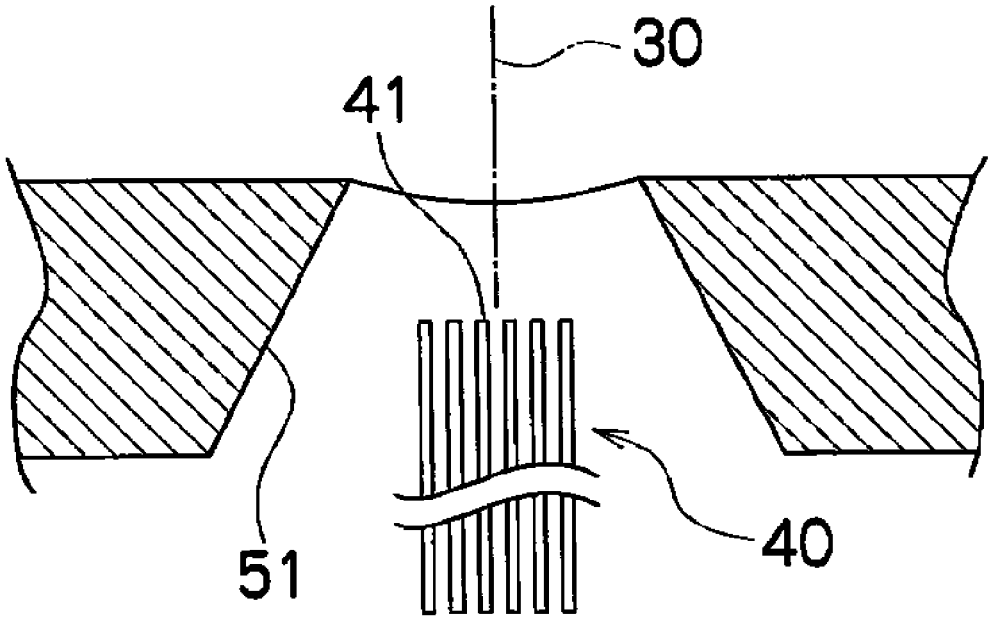
FIG. 12 is a cross-sectional diagram showing the principal part of a liquid ejection head having a gas supply pipe connected to the outside air.

FIG. 12 shows a case where a pipe connected to the outside air (air connection pipe) is used as the gas pipe 40. The gas port 41 is formed at an end of the gas pipe 40 and the other end is open to the outside air. Minute bubbles are naturally supplied through the gas pipes 40 due to the negative pressure created by the liquid ejection, and these minute bubbles coalesce into a single bubble, which is naturally supplied into the liquid column. In this case, it is necessary to determine the structure and to adjust the steady pressure in such a manner that the timing at which the bubble is pulled out corresponds to the timing shown in FIG. 2.

Figure 13:
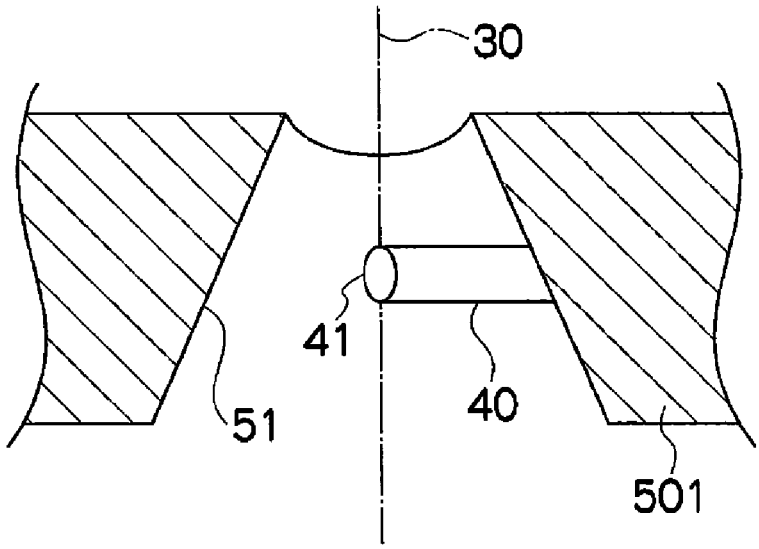
FIG. 13 is a cross-sectional diagram showing the principal part of a further embodiment of the liquid ejection head.

Moreover, FIG. 4 shows the case where the gas pipe 40 is disposed in parallel with the ejection axis 30 of the nozzle 51; however, the present invention is not limited to cases of this kind. As shown in FIG. 13, it is also possible to dispose the gas pipe 40 in a non-parallel fashion with respect to the ejection axis 30. In the present embodiment, the gas port 41 is disposed on the ejection axis 30 of the nozzle 51. Furthermore, in the present embodiment, the gas supply side of the gas pipe 40 is disposed in the nozzle plate 501 in which the nozzle 51 is formed.

Figure 14:
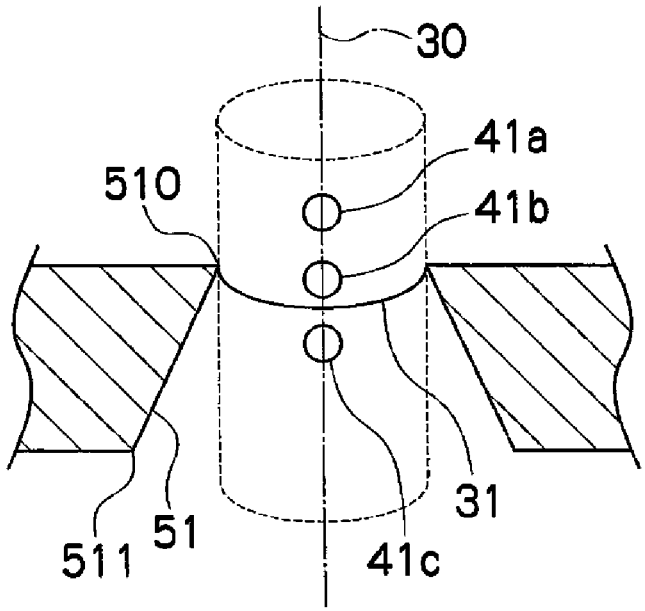
FIG. 14 is a cross-sectional diagram showing variation in the position of the gas port.

Furthermore, FIG. 4 shows the case where the gas port 41 is disposed to the liquid supply side of the position of the outlet 510 of the nozzle 51 (the pressure chamber 52 side in FIG. 4); however, the present invention is not limited to cases of this kind. It is also possible to dispose the gas port to the liquid ejection side of the position of the outlet 510 of the nozzle 51, as a gas port 41*a* in FIG. 14, and it is also possible to dispose the gas port at the position of the outlet 510 of the nozzle 51, as a gas port 41*b*.

The diameter of the gas port 41 (41*a*, 41*b*, 41*c*) is smaller than the diameter of the outlet 510 of the nozzle 51. The nozzle 51 according to the present embodiment has a s tapered shape, and the diameter of the outlet 510 of the nozzle 51 is smaller than the diameter of the inlet 511 of the nozzle 51.

If the large bubble is injected at a speed equal to or slower than the liquid, then a mode can be adopted in which the gas port is disposed on the liquid ejection side, as the gas port 41*a* . This is because, when a large bubble is injected at low speed, the bubble elongates and becomes distributed to a long and thin shape inside the liquid column.

If the large bubble is injected at a speed higher than the liquid, or if the small bubble is injected, then any of the positions of the gas ports 41*a* , 41*b* and 41*c* is possible. In other words, the position of the gas port may be on the liquid ejection side or on the liquid supply side.

IS If the bubble is to be injected at the base of the liquid column during the pulling action of the meniscus 31 immediately after the initial pushing, then the gas port is disposed on the liquid supply side with respect to the position of the outlet 510 of the nozzle 51, as the gas port 41*c*.

In the liquid ejection head 50 according to the above-described embodiment, pressure is applied to the liquid inside in the nozzle 51, the liquid is thereby pushed out from the nozzle 51, the liquid column is caused to grow, a bubble having a smaller diameter than the diameter of the base of the liquid column is injected into the base of the liquid column during its growth, the liquid column is severed by the bubble, and the separated liquid column becomes a droplet, which flies off. Consequently, the liquid column is severed rapidly and satellite-free ejection can be achieved without any fall in the ejection speed.

Image Forming Apparatus

Figure 15:
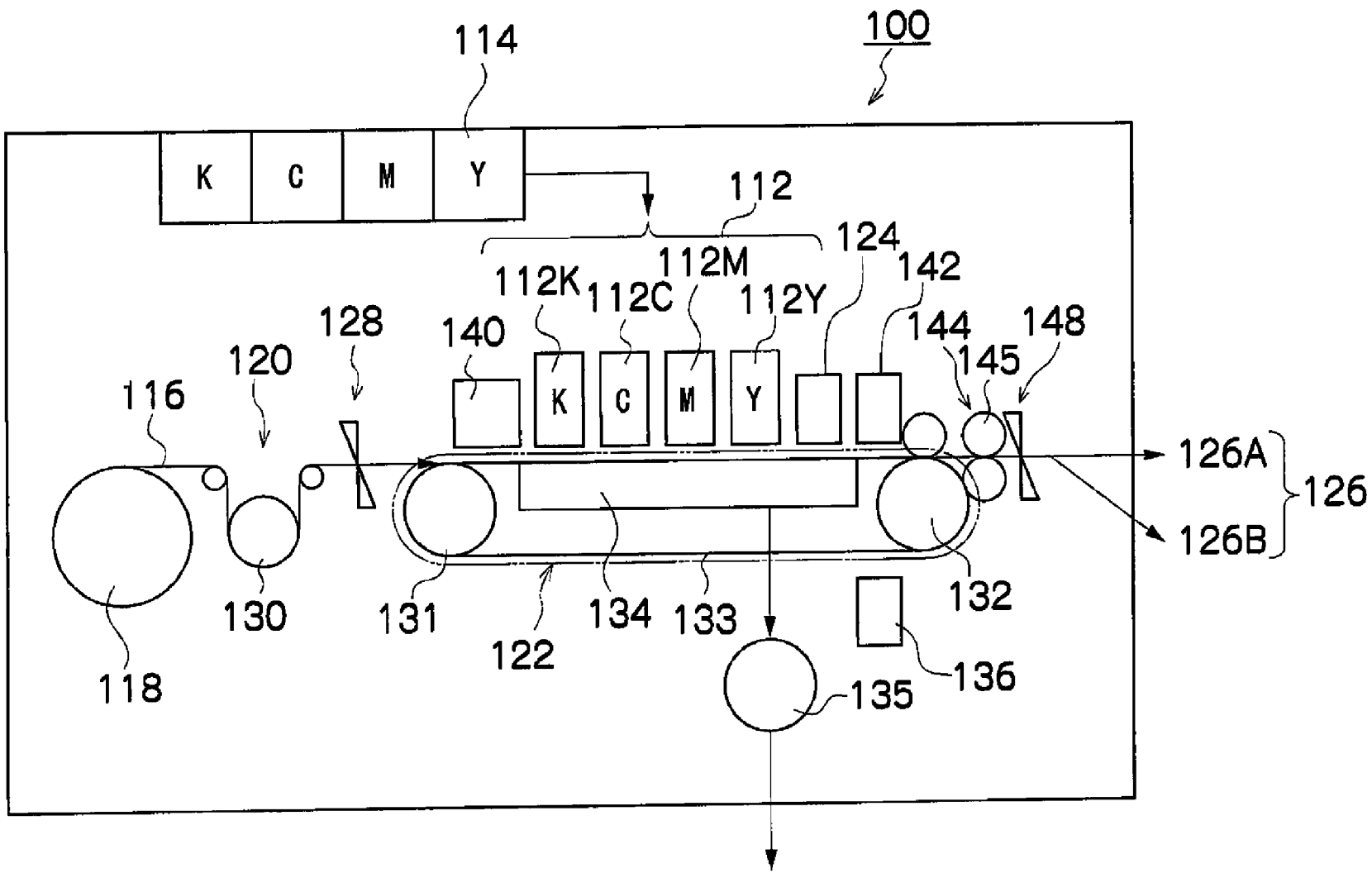
FIG. 15 is a general schematic drawing showing an image forming apparatus according to the present embodiment.

FIG. 15 is a general schematic drawing of an image forming apparatus 100, which corresponds to a liquid ejection apparatus according to an embodiment of the present invention.

In FIG. 15, the image forming apparatus 100 includes: a liquid ejection unit 112, which has a plurality of liquid ejection heads 112K, 112C, 112M and 112Y provided for a plurality of colors of inks; an ink storing and loading unit 114, which stores the inks to be supplied to the liquid ejection heads 112K, 112C, 112M and 112Y; a paper supply unit 118, which supplies a recording medium 116 such as paper (ejection receiving medium); a decurling unit 120, which removes curl from the recording medium 116; a conveyance unit 122, disposed so as to oppose the nozzle surface of the liquid ejection unit 112, which conveys s the recording medium 116 while keeping the recording medium 116 flat; an ejection determination unit 124, which reads out the ejection results produced by the liquid ejection unit 112 (the deposition state of the liquid droplets); and a paper output unit 126, which outputs the printed recording medium to the exterior of the apparatus.

The liquid ejection head 50 shown in FIGS. 3 and 4 is used as each of the liquid ejection heads 112K, 112C, 112M and 112Y in FIG. 15.

An image is formed on the recording medium 116 by ejecting liquids (inks) including coloring materials (also called "colorants") onto the recording medium 116 from the liquid ejection heads 112K, 112C, 112M and 112Y.

FIG. 15 shows the paper supply unit 118, which supplies rolled paper (continuous paper) for example; however, it is also possible to use a configuration in which previously cut paper is supplied. In the case of the apparatus configuration which uses rolled paper, a cutter 128 is provided. The recording medium 116 supplied from the paper supply unit 118 generally has residual curl. In order to remove the curl, heat is applied to the recording medium 116 in the decurling unit 120 by a heating drum 130 in the direction opposite to the direction of curl. After decurling, the cut recording medium 116 is delivered to the conveyance unit 122.

After decurling, the cut recording paper 116 is conveyed in a nip mechanism by a pair of conveyance rollers 131, and is supplied onto a platen 132. A pair of conveyance rollers 133 is also disposed after the platen 132 (to the downstream side of the liquid ejection unit 112), and the recording paper 116 is conveyed at a prescribed speed in conjunction with the front-stage pair of conveyance rollers 131 and the rear-stage pair of conveyance rollers 133.

The platen 132 functions as a member which holds (supports) the recording paper 116 while keeping the recording paper 116 flat (recording medium holding device), as well as functioning as a rear surface electrode. The platen 132 in the FIG. 15 has a broader width than the recording paper 116, and at least the portion opposing the nozzle surface of the liquid ejection unit 112 and the sensor surface of the ejection determination unit 124 is constituted so as to form a horizontal surface (flat surface).

A heating fan 140 is arranged on the upstream side of the liquid ejection unit 112 in the paper conveyance path formed by the conveyance unit 122. This heating fan 140 blows heated air onto the recording medium 116 before printing, and thereby heats up the recording medium 116. Heating the recording medium 116 before printing means that the ink will dry s more readily after landing on the paper.

The liquid ejection unit 112 is a so-called "full line head" in which a line head having a length corresponding to the maximum paper width is arranged in a direction (main scanning direction) that is perpendicular to the medium conveyance direction (sub-scanning direction). More specifically, each of the liquid ejection heads 112K, 112C, 112M, and 112Y is a line head, in which a plurality of nozzles (liquid ejection ports) are arranged along a length that exceeds at least one side of the maximum-size recording medium 116 intended for use in the image forming apparatus 100.

The liquid ejection heads 112K, 112C, 112M, 112Y corresponding to respective ink colors are disposed in the order, black (K), cyan (C), magenta (M) and yellow (Y), from the upstream side, following the direction of conveyance of the recording medium 116 (medium conveyance direction). A color image can be formed on the recording medium 116 by ejecting the inks including coloring materials from the liquid ejection heads 112K, 112C, 112M, and 1 12Y, respectively, onto the recording medium 116 while conveying the recording medium 116.

The liquid ejection unit 112, in which the full-line heads covering the entire width of the paper are thus provided for the respective ink colors, can record an image over the entire surface of the recording medium 116 by performing the action of moving the recording medium 116 and the liquid ejection unit 112 relative to each other in the medium conveyance direction (sub-scanning direction) just once (in other words, by means of a single sub-scan). Higher-speed printing is thereby made possible and productivity can be improved in comparison with a shuttle type head configuration, in which an ink ejection head moves a direction (main-scanning direction) that is perpendicular to the medium conveyance direction reciprocally.

The terms main scanning direction and sub-scanning direction are used in the following senses. More specifically, in a full-line head comprising rows of nozzles corresponding to the entire width of the recording medium, the "main scanning" is defined as printing one line (a line formed of a row of dots, or a line formed of a plurality of rows of dots) in the breadthways direction of the recording medium (the direction perpendicular to the conveyance direction of the recording medium) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line recorded by a main scanning action (the lengthwise direction of the band-shaped region thus recorded) is called the "main scanning direction".

On the other hand, "sub-scanning" is defined as to repeatedly perform printing of a line (a line formed of a row of dots, or a line formed of a plurality of rows of dots) formed by the main scanning, while moving the full-line head and the recording medium relatively to each other. The direction in which the sub-scanning action is performed is called the "sub-scanning direction". In other words, the conveyance direction of the recording medium is the sub-scanning direction, and the direction perpendicular to the sub-scanning direction is the main scanning direction.

Although a configuration with the four standard colors, K, C, M and Y, is described in the present embodiment, the combinations of the ink colors and the number of colors are not limited to the examples shown in the present embodiment, and light and/or dark inks can be added as required. For example, a configuration is possible in which ink ejection heads for ejecting light-colored inks such as light cyan and light magenta are added.

The ink storing and loading unit 114 has ink tanks for storing the inks of the colors corresponding to the respective liquid ejection heads 112K, 112C, 112M, and 112Y, and the respective ink tanks are connected to the liquid ejection heads 112K, 112C, 112M, and 112Y by means of channels (not shown).

The ejection determination unit 124 has an image sensor (line sensor and the like) for capturing an image of the ejection result of the liquid ejection unit 112, and functions as a device to check for ejection defects such as clogs of the nozzles from the images read by the image sensor.

A post-drying unit 142 is disposed following the ejection determination unit 124. The post-drying unit 142 is a device to dry the printed image surface, and includes a heating fan, for example. A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. In the image forming apparatus 100, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. The cutter 148 is disposed directly in front of the paper output unit 126, and is used for cutting the test print portion from the target print portion when a test print has been performed in the blank portion of the target print. Although not shown, the paper output unit 126A for the target prints is provided with a sorter for collecting prints according to print orders.

FIG. 16 is a block diagram showing a control system of the image forming apparatus 100.

In FIG. 16, the image forming apparatus 100 includes: the liquid ejection head 50 (112 in FIG. 15), a communication interface 201, a system controller 202, memories 203*a* and 203*b* , a conveyance motor 204, a conveyance driver 205, a print controller 206, the head driver 207, a liquid supply unit 208, and a liquid supply control unit 209.

The image forming apparatus 100 has a total of four liquid ejection heads 50 for the colors of black (K), cyan (C), magenta (M) and yellow (Y).

The communication interface 201 is an image data input device for receiving image data transmitted by a host computer 290. It is possible to use a wired or wireless interface for the communication interface 201. The image data acquired by the image foaming apparatus 100 through the communication interface 201 is stored temporarily in the first memory 203 a, which is used to store image data.

The system controller 202 is constituted of a microcomputer and peripheral circuits thereof, and the like, and it forms a main control device which controls the whole of the image forming apparatus 100 in accordance with a prescribed program. More specifically, the system controller 202 controls the respective units of the communication interface 201, the conveyance driver 205, the print controller 206, and the like.

The conveyance motor 204 supplies a motive force to the roller and belt, and the like, in order to convey the ejection receiving medium, such as paper. The ejection receiving medium and the liquid ejection heads 50 are moved relatively with respect to each other, by means of this conveyance motor 204. The conveyance driver 205 is a drive circuit which drives the conveyance motor 204 in accordance with instructions from the system controller 202.

The liquid supply unit 208 supplies the inks from the ink tanks (the ink storing and loading unit 114 in FIG. 15) to the liquid ejection heads 50.

The liquid supply control unit 209 is constituted of a microcomputer and peripheral circuits of same, and it controls the supply of the inks to the liquid ejection heads 50, by means of the liquid supply unit 208.

The print controller 206 is constituted of a microcomputer and peripheral circuits thereof, and the like, and generates the dot data (also called "droplet ejection data") necessary in order to form dots on the ejection receiving medium by ejecting liquid droplets from the liquid ejection heads 50 onto the ejection receiving medium, on the basis of the image data input to the image forming apparatus 100. More specifically, the print controller 206 functions as an image processing device which performs various image treatment processes, corrections, and the like, in accordance with the control implemented by the system controller 202, in order to generate droplet ejection data from the image data inside the first memory 203*a* , and it supplies the dot data thus generated to the head driver 207.

The second memory 203*b* is appended to the print controller 206, and the dot data, and the like, is stored temporarily in the second memory 203*b* during image processing in the print controller 206.

The head driver 207 outputs the liquid ejection drive signals to the liquid ejection piezoelectric elements 58 of the liquid ejection heads 50 on the basis of the dot data supplied by the print controller 206 (the dot data stored in the second memory 203*b* ). By supplying the liquid ejection drive signals outputted from the head driver 207 to the liquid ejection piezoelectric elements 58 of the liquid ejection heads 50, liquid (droplets) are ejected from the nozzles 51 of the liquid ejection heads 50 toward the ejection receiving medium.

Furthermore, the head driver 207 outputs the bubble supply drive signals to the bubble supply piezoelectric elements 48 of the liquid ejection heads 50. By applying the bubble supply drive signals outputted from the head driver 207 to the bubble supply piezoelectric elements 48 of the liquid ejection heads 50, bubbles are injected into the liquid columns from the gas ports 41 in the liquid ejection heads 50.

The cases where the ink is ejected have been described here; however, the present invention is not limited in particular to cases of this kind and it may also be applied to a case where a liquid other than ink is ejected.

The piezo type of liquid ejection head has been described here; however, the present invention is not limited in particular to cases of this kind and it may also be applied to a case using a liquid ejection head other than a piezo type of head, such as a bubble jet head, or the like.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection method of ejecting liquid from a nozzle, comprising the steps of:

growing a column of the liquid from the nozzle; and injecting a bubble into a base of the column of the liquid during growth thereof from the nozzle, by using a bubble supply device which supplies a bubble.

2. The method as defined in claim 1, wherein:

the growing step includes the step of pushing initially a meniscus of the liquid in the nozzle in order to grow the liquid column from the nozzle; and the injecting step is carried out after the pushing step.

3. The method as defined in claim 1, wherein the bubble is pushed out from a gas port disposed inside the nozzle, the bubble being pushed out along a direction in which the liquid is ejected from the nozzle.

4. The method as defined in claim 3, wherein the bubble is pushed out from the gas port at a speed not less than a flow speed of the liquid at the base of the column of the liquid.

5. A liquid ejection method, comprising the steps of:

applying pressure to liquid inside a nozzle and thereby pushing the liquid out from the nozzle to grow a column of the liquid from the nozzle;

injecting a bubble into a base of the column of the liquid during growth thereof, the bubble having a diameter smaller than a diameter of the base of the column of the liquid; and severing the column of the liquid by the bubble and thereby causing the severed column of the liquid to fly off as a droplet of the liquid.

6. The method as defined in claim 5, wherein the bubble is pushed out from a gas port disposed inside the nozzle, the bubble being pushed out along a direction in which the liquid is ejected from the nozzle.

7. The method as defined in claim 6, wherein the bubble is pushed out from the gas port at a speed not less than a flow speed of the liquid at the base of the column of the liquid.

8. A liquid ejection head, comprising:

a nozzle which ejects liquid; and a bubble supply device which injects a bubble into a base of a column of the liquid during growth thereof from the nozzle.

9. The liquid ejection head as defined in claim 8, wherein the bubble supply device includes at least one of a gas port which outputs gas and a heating element.

10. The liquid ejection head as defined in claim 8, wherein the bubble supply device is disposed on an ejection axis of the nozzle.

11. A liquid ejection apparatus comprising the liquid ejection head as defined in claim 8.

12. The liquid ejection apparatus as defined in claim 11, further comprising:

a drive device which synchronizes a liquid ejection waveform that defines push and pull timing of a meniscus of the liquid in the nozzle and a bubble supply waveform that defines injection timing of the bubble by the bubble supply device, and supplies the liquid ejection waveform and the bubble supply waveform to the liquid ejection head, wherein the bubble supply waveform has a pulse waveform for injecting the bubble after an initial pushing of the meniscus by means of the liquid ejection waveform.

* * * * *